US005492522A

United States Patent [19]

Rubar

[11] Patent Number: 5,492,522

[45] Date of Patent: Feb. 20, 1996

[54] METHOD OF MAKING POP-UP ACTION PRODUCTS

[75] Inventor: Sharon Rubar, Countryside, Ill.

[73] Assignee: The Lehigh Press, Inc., Cherry Hill, N.J.

[21] Appl. No.: 189,806

[22] Filed: Feb. 1, 1994

[51] Int. Cl.[6] ..... B31D 5/00

[52] U.S. Cl. ..... 493/325; 493/346; 493/349; 493/357; 493/362; 493/386; 156/226

[58] Field of Search ..... 493/346, 349, 493/357, 358, 359, 360, 362, 386, 324, 325; 156/226, 227, 253, 264, 269, 270

[56] References Cited

U.S. PATENT DOCUMENTS

| | | | |
|---|---|---|---|
| 1,453,833 | 5/1923 | Fleming et al. . | |
| 1,658,968 | 2/1928 | Carroll . | |
| 2,085,803 | 7/1937 | Harrison | 40/28 |
| 2,098,568 | 11/1937 | Cone | 40/65 |
| 2,214,593 | 9/1940 | Mustin | 493/346 |
| 2,360,973 | 10/1944 | Pedersen | 493/346 |
| 2,485,806 | 10/1949 | Berg | 40/62 |
| 2,534,631 | 12/1950 | Simpson | 46/119 |
| 3,721,029 | 3/1973 | Austin | 40/124.1 |
| 3,956,049 | 5/1976 | Johnsen | 156/200 |
| 3,994,091 | 11/1976 | Modell | 46/37 |
| 4,080,236 | 3/1978 | Schulhof et al. | 156/220 |
| 4,518,451 | 5/1985 | Luceri | 156/226 |
| 4,586,279 | 5/1986 | Hopkins | 40/124.1 |
| 4,874,356 | 10/1989 | Volkert | 493/346 |
| 4,963,125 | 10/1990 | Volkert | 493/346 |
| 5,010,669 | 4/1991 | Moran | 40/539 |
| 5,078,670 | 1/1992 | Volkert | 493/346 |
| 5,088,220 | 2/1992 | Hibsch | 40/488 |
| 5,157,852 | 10/1992 | Patrou et al. | 40/160 |
| 5,181,901 | 1/1993 | Volkert | 493/357 |
| 5,215,792 | 6/1993 | Miller | 428/14 |
| 5,346,455 | 9/1994 | Volkert | 493/357 |

*Primary Examiner*—Jack W. Lavinder
*Attorney, Agent, or Firm*—Trexler, Bushnell, Giangiorgi & Blackstone, Ltd.

[57] ABSTRACT

A method of manufacturing pop-up action products from a single continuous web of material. A preferred form of the method includes the steps of cutting the web into two separate ribbons, defining a continuous series of predetermined shapes in one of the ribbons, marrying the two separate ribbons so that they are joined to one another at each of the series of predetermined shapes in such a fashion that, after transverse separation into individual pop-up action products, the linear movement of a slide panel member results in the elevational movement of a predetermined "pop-up" shape.

14 Claims, 3 Drawing Sheets

38
40
44
42
50
46
48
52
34
32

34
37
32

32
54
40
42
50
56
58
52
34

32
54
34
56

66
40
64
62

64
42
62

68
66'
64
42
74
70

METHOD OF MAKING POP-UP ACTION PRODUCTS

BACKGROUND OF THE INVENTION

The present invention relates generally to a method of making a pop-up action product from a single, continuous web of material.

Generally speaking, a pop-up action product is a paper device in which a cut-out of a specified shape is movably attached to an internal slide panel member so that lateral movement of the slide panel member results in the "popping up" of the specified shape away from the remainder of the product. The full extension of the slide panel member results in the complete elevation of the specified shape so that it is essentially perpendicular to the remainder of the product. A pop-up action product provides a novel and amusing device. It can be used to suit many purposes, such as a vehicle for promotions, an advertising piece, an informative device, a game of chance, etc.

For many years various advertising and promotional novelties incorporating sliding and pop-out members have been manufactured by various methods. To the best of the applicant's knowledge, however, none of these methods have produced a pop-up action product of the type described, fabricated from an initial single web of material. Such a method of fabricating pop-up action products is preferable in that the employment of a single roll of paper stock affords the convenient feeding of paper in one-pass through the printing and in-line finishing machinery at a high rate of speed. This allows for the production of thousands of pieces per hour, while minimizing both the time and the cost of production.

OBJECTS AND SUMMARY OF THE INVENTION

It is a general object of this invention to provide a novel and improved method of making a pop-up action product.

A related object is to provide a method of making pop-up action products in a "single-pass" type of operation from a single continuous web of paper stock.

It is a further object of the present invention to provide a method of fabricating pop-up action products that are suitable for a variety of uses.

A still further object of the present invention is to provide a method whereby the manufacture of up to thousands of pop-up action products per hour is possible.

Briefly, and in accordance with the foregoing objects, a method of fabricating a pop-up action product from a single continuous web of material comprises the steps of cutting the web of material into at least first and second ribbons, preferably gluing and folding or ribboning said first ribbon to form a continuous series of slide panel members of at least double thickness, die cutting a continuous series of predetermined pop-up shapes in the second ribbon, simultaneously die cutting thumb-shaped cutouts at predetermined locations on the second ribbon (thereby ultimately providing access to the slide panel members), providing perforations or score lines to facilitate movement of the predetermined pop-up shapes, applying glue at preselected locations adjacent to, and/or on the pre-cut predetermined pop-up shapes, superimposing the first ribbon carrying the slide panel members onto the second ribbon carrying the pre-cut, predetermined pop-up shapes so that the ribbons are married at preselected glue locations, and transversely cutting the married webs into a plurality of pop-up action products.

Other objects and features of the invention will be readily apparent from the following detailed description of the drawings.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawing in which like reference numerals identify like elements, and in which:

DETAILED DESCRIPTION OF THE ILLUSTRATED EMBODIMENT

Figure 1:
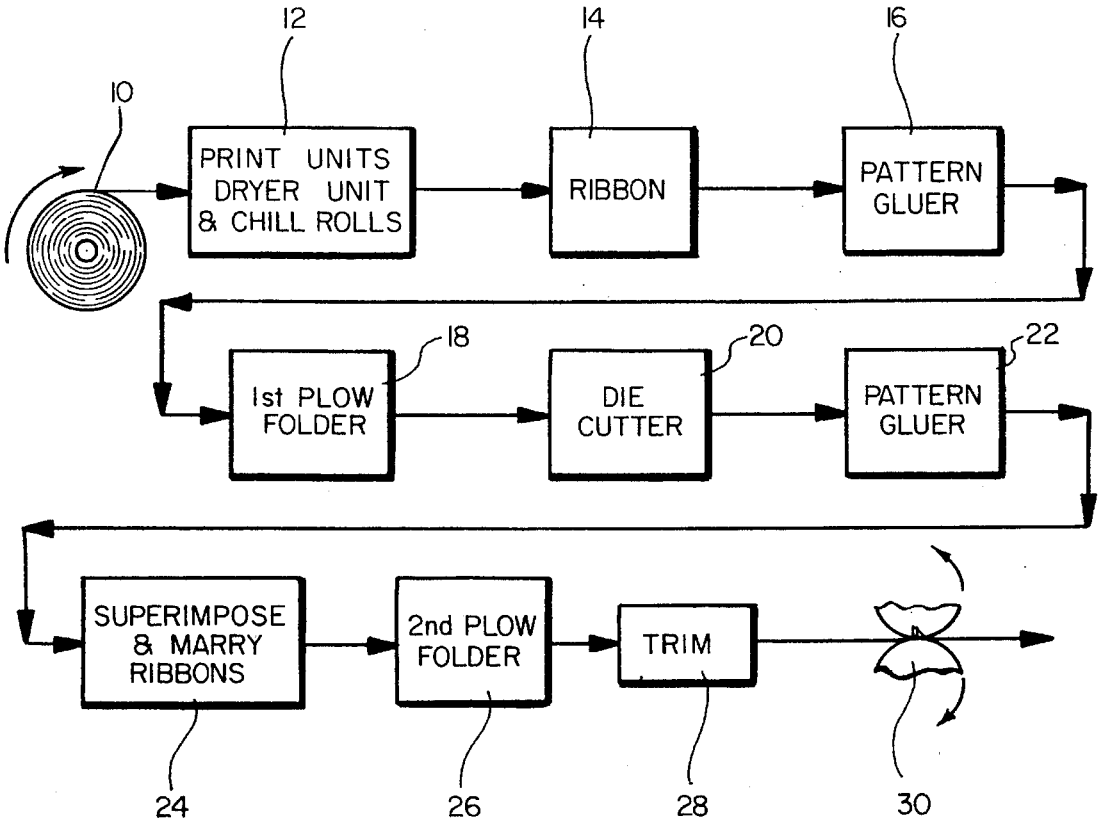
FIG. 1 is a block diagram which illustrates the steps of a preferred method of fabricating a continuous series of pop-up action products.

Referring to the drawings, and initially to FIG. 1, a preferred method of fabricating a pop-up action product in accordance with the invention will be described.

FIG. 1 illustrates the steps in a preferred method of fabricating a series of pop-up action products from a single continuous web of material, designated generally by the reference numeral 10, in block diagram form.

Initially, any printing to be included in the final product is printed at the desired locations on the web of material 10 as illustrated in block 12 of FIG. 1. Thereafter, as illustrated by block 14, the web 10 is longitudinally cut or "ribboned" into first and second ribbons. The first ribbon, which will sometimes be referred to as a slide panel member ribbon, is of a preferably lesser width than the remaining second ribbon which will carry a series of predetermined shapes as will be presently described. Next referring to block 16, an area of pattern glue is applied to one portion of the first ribbon such that during a subsequent folding step (illustrated by block 18), a resultant slide panel member ribbon will be formed of a thickness twice that of the web of material 10. It should be noted that the location of the area of pattern glue applied is not critical. Further, it is clearly contemplated that the slide panel member ribbon can be more than twice the thickness of the web 10, which multiple thickness can be achieved by either multiple folding operations or multiple ribboning of the slide panel member ribbon. The significance of the slide panel member ribbon will become apparent herein below.

Block 20 of FIG. 1 illustrates a die cutting operation whereby, a series of predetermined shapes are defined in the second ribbon. In a preferred method, a series of thumb-tab shaped cut-outs, parallel longitudinal cuts and transverse parallel perforations (all designed to facilitate movement of the predetermined shape in the final product), are simultaneously made during the die cutting operation. Following completion of the die cutting operation, areas of glue are applied to the second ribbon adjacent to and/or on the series of predetermined shapes as illustrated by block 22. Alternatively, certain of these areas of glue can be applied to the first ribbon, as will become more apparent below. These areas of glue provide a means of partially joining the first and second ribbons in such a fashion that, in the finished product, movement of the slide panel member will result in the desired movement of the predetermined shape. In order that such a joining can occur, the method next provides for the superimposition of the first ribbon over the second ribbon and the marrying of the two ribbons as shown in block 24 of FIG. 1.

Block 26 illustrates a second folding step. In this step, the second ribbon, after being married to the first ribbon, is folded over upon itself and comes in contact with the areas of glue previously laid down (as illustrated in block 22), resulting in the enclosure of the first ribbon therein. As discussed with reference to an earlier folding operation, however, a slitting operation can be used here to accomplish the same result.

In order that the finished product may be of a specified size, a face trimming operation is utilized whereby the second ribbon is longitudinally trimmed along either or both edges after it has been folded over upon, and secured to, itself. This step is illustrated in block 28 of FIG. 1. As is known in the industry, such a step also provides for smoother edges and, therefore, a neater appearance of the finished product. The final step of transversely cutting the web into a series of individual pop-up action products, is shown in FIG. 1 by the depiction of a rotary cutter designated by reference numeral 30.

Figure 2:
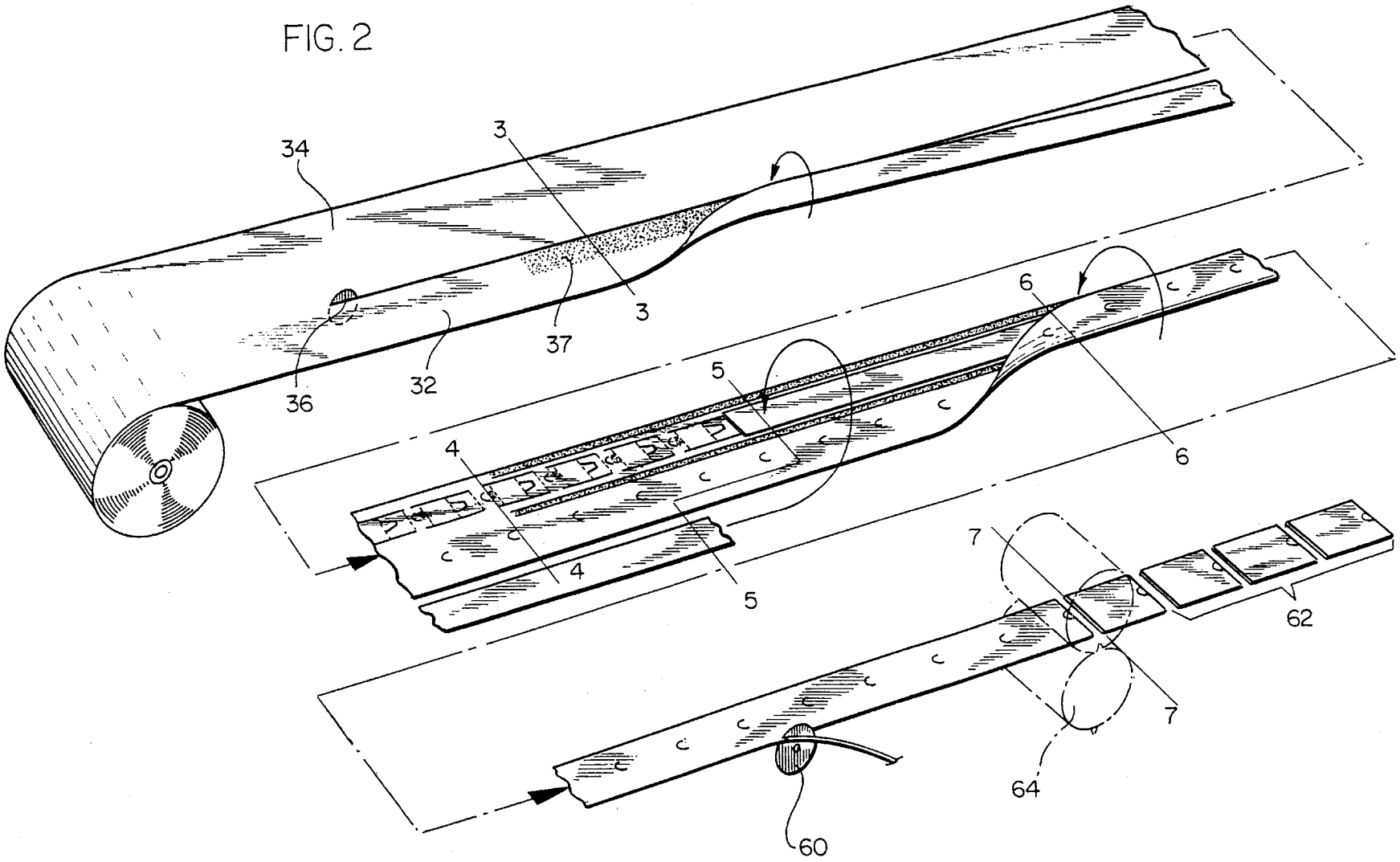
FIG. 2 is a diagrammatic illustration of the method for fabricating a series of pop-up action products, as shown in FIG. 1.
Figures 3, 4, 5, 6, 7, 8, 9:
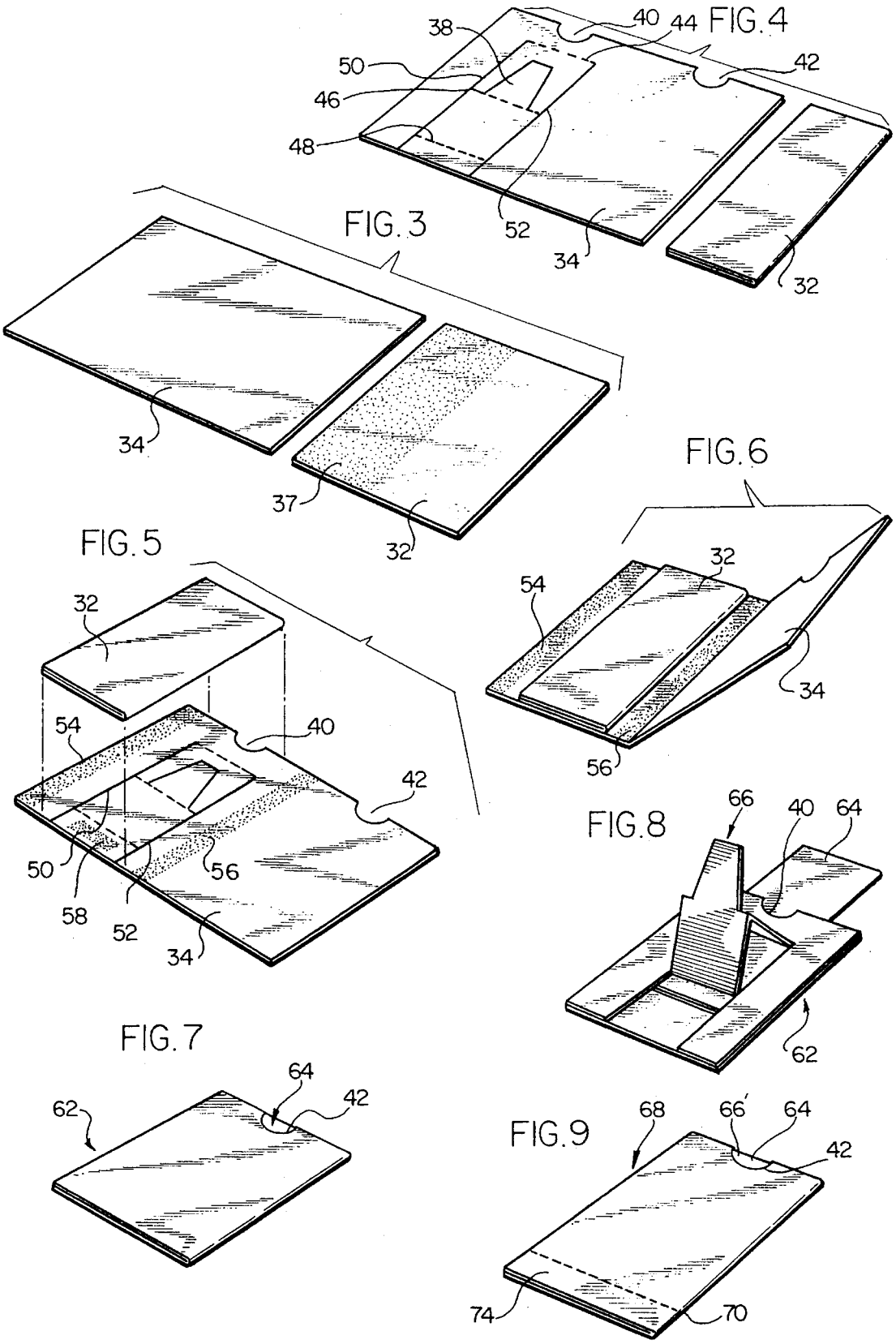
FIG. 3 illustrates the web cut into two ribbons with an area of glue applied to the first ribbon, as has occurred at line 3—3 in FIG. 2.
FIG. 4 illustrates the first ribbon folded over to form a slide panel member ribbon, and the second ribbon die cut to form a predetermined shape, having thumb-tab shaped cutouts, and lines of perforation, as has occurred at line 4—4 in FIG. 2.
FIG. 5 illustrates areas of glue applied to the second ribbon, and the first ribbon superimposed on the second ribbon, as has occurred at line 5—5 in FIG. 2.
FIG. 6 illustrates the marriage of the first ribbon onto the predetermined shape area of the second ribbon, and the folding of the second ribbon around the first ribbon, as has occurred at line 6—6 in FIG. 2.
FIG. 7 is a perspective view of a transversely separated, completed pop-up action product with the slide panel member enclosed therein; as has occurred at line 7—7 in FIG. 2.
FIG. 8 is a perspective view of the completed pop-up action product with the slide panel member partially extended and the pop-up shape partially elevated.
FIG. 9 is a perspective view of a modified pop-up action product produced by an alternative method as discussed below.

Now referring to FIG. 2, in conjunction, sequentially, with FIGS. 3–7, the steps which comprise the present invention of making a series of pop-up action products from a single continuous web of material are described in greater detail, and should be more easily understood. The direction of movement of the one-pass of the web of material 10 through in-line finishing machinery for processing the same into a more or less continuous stream of like products is as indicated by the arrow connecting the three (3) portions of FIG. 2. FIG. 2, in conjunction with FIG. 3, clearly illustrates that the first step in the preferred method is to slice, or "ribbon" the continuous web 10 into a first ribbon 32, and a second ribbon 34. A cutting wheel 36 is used to physically separate the web 10, the operation of which is well known in the art. Also illustrated in FIGS. 2 and 3 is the application of an area of glue 37 to a portion of the first ribbon 32, whereby in the subsequent folding step illustrated in FIGS. 2 and 4, the first ribbon 32 is folded over upon itself resulting in a slide panel member ribbon twice the thickness of the web of material 10. In a first alternative method in which the web of material 10 comprises paper stock of sufficient weight (i.e., seven-point or eighty pound weight), a double thickness is not required to form the slide panel member ribbon. Therefore, the steps of applying an area of pattern glue to the first ribbon and longitudinally folding the first ribbon as discussed above are eliminated. The resultant slide panel member ribbon in this alternative method, therefore, is of a thickness equal to that of the web of material 10. In additional alternative methods, several areas of glue 37 may be applied at various locations to form more than a double-thickness slide panel member ribbon. Such multiple thickness slide panel member ribbons can be formed in multiple folding operations or multiple ribboning operations without departing from the scope of the invention.

Continuing with the preferred method, once separated into first ribbon 32 and second ribbon 34, a number of additional finishing operations are performed. As shown in FIGS. 2 and 4, a die-cutting operation is utilized to define a series of predetermined shapes 38 in the second ribbon 34. Preferably, at the same time that the shapes 38 are cut, a series of thumb-tab shaped cutouts 40 and 42 are made in the second ribbon 34 at the predetermined locations shown. As will become more apparent below, to facilitate movement of the predetermined shapes 38 in the finished product, a series of transverse parallel perforations, such as 44, 46 and 48 in the example shown, are also made at this time along the portion of the second ribbon 34 which defines the series of predetermined shapes 38. It should be apparent to one of ordinary skill in the art that score lines could be utilized instead of perforation lines if so desired.

Still referring to FIGS. 2 and 4, a series of parallel longitudinal cuts 50 and 52 are made alongside the series of predetermined shapes 38. The parallel cuts 50 and 52 allow for movement of the predetermined shapes 38 in the final product, as will be described hereinbelow.

Referring now to FIGS. 2 and 5, the method next proceeds by applying areas of glue 54, 56 and 58 to the second ribbon 34 adjacent to and on the series of predetermined shapes 38. Two areas of glue 54 and 56 are applied in parallel proximity to the series of longitudinal cuts 50 and 52. The third area of glue 58 is applied to the lower portion of the series of predetermined shapes 38 so that in the final product, as will be explained in greater detail below, movement of the predetermined shape 38 can be effectuated. As can be seen in FIGS. 2 and 5, the slide panel member ribbon 32 is superimposed over the second ribbon 34 so that a portion of the slide panel member ribbon 32 is aligned with the area of glue 58 on the lower portion of the series of predetermined shapes 38. Accordingly, the area of glue 58 could also be applied at the appropriate location on the slide panel member ribbons to achieve the same result.

Next, the second ribbon 34 is folded over upon itself (or, if desired, ribboned and superimposed) to enclose the slide panel member ribbon 32 therein, as best seen in FIG. 6. As a result of this folding step, the second ribbon 34 is sealed along the longitudinally placed areas of glue 54 and 56. Further, the folding over of the second ribbon 34 brings the slide panel member ribbon 32 into contact with the areas of glue 58 located along the lower portion of the predetermined shapes 38.

Referring to FIG. 2, the preferred method next includes the step of face trimming the second web after it is folded, as described above, at trimming wheel 60 so that the resultant finished product will be of a specified size.

Finally, as shown in FIGS. 2 and 7, individual pop-up action card products 62 are formed by a rotary cutter 64 which transversely chops the web 10 at the desired interval between each predetermined shape 38, or a multiple number thereof.

The finished product 62, with a slide panel member 64 partially extended and the resultant partial elevation of a predetermined shape 66, can be seen in FIG. 8. As should be apparent, linear movement of the slide panel member 64 will result in the elevational, or "pop-up", movement of the predetermined shape 66. As can be seen in FIGS. 7, 8 and 9, access to the slide panel member 64 is made possible by way of the thumb-tab shaped cutouts 40 and 42.

An alternative form of the finished product 68 is shown in FIG. 9 wherein an additional transverse perforation line 70 has been made during the die cutting operation along the lower-most sections of the slide panel member ribbon 32 and the second ribbon 34 carrying the series of predetermined shapes 38, whereby, in the alternative final product 68, movement of the predetermined shape 66 can only be effectuated by the complete removal of a section 74 from the remainder of the pop-up action product. It is envisioned that such a product might be useful for "sweepstakes" type games wherein the maintenance of the secrecy of the contents of the pop-up action product would be temporarily desired.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A method of making a plurality of individual pop-up action products in a continuous manner, comprising the steps of: slitting a continuous web of paper into at least first and second ribbons; at least partially cutting a portion of said second ribbon to define a series of predetermined shapes therein; superimposing and marrying said first and second ribbons; adhesively securing said first and second ribbons at or adjacent to each of said series of predetermined shapes; and, transversely cutting the adhesively secured first and second ribbons between each, or a multiple number, of said series of predetermined shapes, thereby forming a succession of individual pop-up action products wherein said transversely cut first ribbon forms a slide panel in each product such that a relative linear movement of said slide panel results in a relative elevational movement of the one, or a multiple number, of predetermined shapes of each product.

2. The method of claim 1, wherein the step of at least partially cutting a series of pre-determined shapes on said second ribbon is performed before the web is slit into at least first and second ribbons.

3. The method of claim 1, wherein said second ribbon is significantly wider than said first ribbon, and the method includes the further step of longitudinally folding said second ribbon along a fold line such that said first ribbon is substantially enclosed within said folded second ribbon.

4. The method of claim 1, wherein said second ribbon is significantly wider than said first ribbon, and the method includes the further step of slitting the said second ribbon into two parts and sandwiching said first ribbon between said two parts of said second ribbon.

5. The method of claim 1 or 2, further comprising the step of applying longitudinal lines of adhesive to said second ribbon at one or more locations outside of an area on said second ribbon whereupon said first ribbon is superimposed and married.

6. The method of claim 1 or 2, wherein the step of at least partially cutting a series of predetermined shapes further comprises simultaneously cutting an opening for ultimate use in grasping said slide panel.

7. The method of claim 1 or 2, wherein the step of partially cutting a series of predetermined shapes further comprises simultaneously partially cutting, scoring or perforating at locations across and/or adjacent to said series of predetermined shapes in order to ultimately facilitate the linear movement and elevation of the predetermined shapes.

8. The method of claim 1, further comprising longitudinally folding said first ribbon along a fold line one or more times, thereby forming a first ribbon which has a thickness which is a multiple of an initial thickness of said continuous web of paper.

9. The method of claim 8, further comprising applying an area of glue to one portion of said first ribbon prior to folding said first ribbon one or more times.

10. The method of claim 1, further comprising the step of slitting said first ribbon into one or more ribbons of lessor width, and stacking and securing said one or more ribbons of lessor width upon one another, whereby forming a first ribbon which has a thickness which is a multiple of an initial thickness of said continuous web of paper.

11. The method of claim 1 or 2, further comprising defining a removable portion on said first and second ribbons adjacent to a lower portion of one or more of said predetermined shape by transversely perforating said first and second ribbons after said superimposing, marrying and adhesively securing steps, thereby creating a series of removable portions longitudinally separating one or more of said predetermined shapes defined along said continuous web.

12. The method of claim 11, wherein the step of transversely cutting the web of material between each, or a multiple number, of said series of predetermined shapes to form individual pop-up action products is adjusted so as to include one of said series of removable portions with each individual pop-up action product created.

13. The method of claim 1, further comprising an initial step of printing said continuous web of material.

14. The method of claim 1 or 2, wherein said steps are performed in the order recited therein.

* * * * *